United States Patent [19]

Files

[11] 4,452,056

[45] Jun. 5, 1984

[54] LIQUID EXTRACTING APPARATUS

[75] Inventor: William C. Files, Destrehan, La.

[73] Assignee: Pellerin Milnor Corporation, Kenner, La.

[21] Appl. No.: 489,064

[22] Filed: Apr. 27, 1983

[51] Int. Cl.[3] ..... D06F 47/06

[52] U.S. Cl. ..... 68/242; 68/210; 100/211; 100/127

[58] Field of Search ..... 68/242, 210, 21, 96, 68/241; 100/211, 116, 126, 127, 128, 129

[56] References Cited

U.S. PATENT DOCUMENTS

| | | | |
|---|---|---|---|
| 2,576,776 | 11/1951 | Cavagnaro, Jr. et al. | 68/241 |
| 2,698,976 | 1/1955 | Taccone | 100/211 X |
| 3,460,363 | 8/1969 | Grantham | 100/127 X |
| 4,152,268 | 5/1979 | Krause | 100/211 X |
| 4,249,400 | 2/1981 | Arendt | 68/242 |

FOREIGN PATENT DOCUMENTS

| | | | |
|---|---|---|---|
| 51721 | 5/1982 | European Pat. Off. | 68/242 |
| 2846760 | 5/1979 | Fed. Rep. of Germany | 68/241 |
| 539106 | 12/1976 | U.S.S.R. | 68/242 |

*Primary Examiner*—Philip R. Coe
*Assistant Examiner*—Frankie L. Stinson
*Attorney, Agent, or Firm*—Vaden, Eickenroht, Thompson, Bednar & Jamison

[57] ABSTRACT

There is disclosed apparatus for extracting liquid from cloth goods, such as laundry from a washing machine, wherein a dome having a diaphragm across its lower end is mounted above a press plate which is reciprocable beneath the dome between an upper position adjacent the diaphragm, whereby the diaphragm may be inflated by fluid pressure supplied to the dome in order to press a batch of goods received on the press plate, and a lower position to permit the pressed goods or cake to be moved laterally off the press plate and another batch to be received thereon at the start of a subsequent press cycle, and a basket is mounted for shifting vertically between an upper position to form with the press plate a container for the goods which are received thereon, and a lower position beneath the top side of the press plate as the press plate is raised to its upper position as well as upon lowering of the press plate to permit removal of the cake.

5 Claims, 10 Drawing Figures

10
1,2
3,4
22
23
26
27
30
30A
31
32
33
35
36
37
38
38B
41
42
43
45
46
48
49
50
51

LIQUID EXTRACTING APPARATUS

This invention relates generally to apparatus for use in extracting liquid from cloth goods by arranging a bath thereof beneath a fluid pressure inflatable diaphragm across the open lower end of a dome. More particularly, this invention relates to improvements in apparatus of this type wherein a hollow basket is mounted for reciprocation between the dome and the press plate between one position forming with the top side of the press plate a container into which the goods may be emptied and in which the goods are confined as the press plate and dome are moved into positions opposite one another, and an alternate position removed from the top side of the press plate to permit the pressed goods or "cake" to be pushed laterally off the top side of the press plate.

German Off. No. 2,602,845 shows apparatus of this type wherein the dome is mounted on a ram for vertical reciprocation toward and away from the press plate so that, with the dome raised and the basket lowered onto the press plate to form a container for the goods, a space is formed between the upper edge of the bakset and the dome through which the goods may be emptied into the container. Then, with the goods confined in the basket, the diaphragm may be moved with the dome down into the basket to press the goods against the press plate, and upon raising of the dome, the basket may also be raised to lift its lower end to a position above the press plate which forms a space through which the pressed goods or cake to be pushed laterally off the press plate. However, in this apparatus, as in prior apparatus in which a diaphragm is lowered into a container for the goods, the goods may be caught between the edge of the diaphragm and the basket.

U.S. Pat. No. 4,249,400 shows other apparatus of this type, wherein, as in the apparatus above described, the dome is carried by a ram or vertically reciprocable actuator to permit the diaphragm to be moved toward or away from the press plate, and a so-called charging frame or basket is arranged for vertical reciprocation between the dome and a press plate beneath it. More particularly, the basket is mounted for vertical reciprocation between an upper position, when the dome is raised, in which its lower end is spaced above the press plate to permit the cake to be moved laterally off the press plate, and another position in which its lower end is spaced beneath the dome and in which its upper end is above the press plate to form therewith a container into which a batch of the goods may be emptied. However, upon loading of the container, the periphery of the diaphragm is moved downwardly to engage with a flange or rim on the upper end of the basket and force the basket down with the dome through an annular slot in the press floor about the periphery of the press plate. Liquid pressed from the goods during lowering of the basket with the dome, and subsequent inflation of the diaphragm, drains through perforations in the press plate into a sump beneath the floor. The ram is then raised and the basket lifted to its upper position to free the cake therefrom and permit a pusher to move the cake laterally off the press plate.

Although such apparatus avoids the need for lowering the diaphragm into the basket, shifting of the basket between its various positions, as above described, requires considerable time which is often critical as, for example, when the operation of the apparatus is to be coordinated with other timed equipment, such as a continuous, batch type washing machine. Also, since the basket is lifted to permit removal of the cake, goods may be caught within the upper end of an annular slot into the sump as they are moved laterally off of the press plate. Similar problems may also be encountered in moving the cake laterally across perforations in the press plate.

It is therefore a primary object of this invention to provide apparatus of the type described wherein liquid may be pressed from the goods in the basket without the necessity of moving the diaphragm into the basket, and further in which the dome and basket are so constructed and operated as to reduce the time required to properly position the basket during a complete press cycle as well as to avoid damaging the cake as it is removed laterally off the press plate.

More particular objects are to provide apparatus of the type above described wherein liquid may be quickly drained from the goods and in which the top side of the press plate and pusher are so constructed and arranged with respect to one another as to facilitate movement of the cake laterally off the press plate without damage to the cake.

These and other objects are accomplished, in accordance with the illustrated embodiment of the present invention, wherein, as compared with the above-described prior apparatus, the dome is supported by a frame with the diaphragm across its lower end spaced above the top side of the press plate, the press plate is mounted for vertical reciprocation toward and away from the dome, and the basket is mounted for vertical reciprocation within a sump which depends from the press plate between an upper position in which its upper end is above the top side of the press plate to form a container into which a batch of the goods may be emptied, and a lower position in which its upper end is substantially flush with the top side of the press plate.

More particularly, during the press cycle, the press plate first occupies a lower position in which the upper end of the basket, when raised to its upper position, is spaced beneath the dome, so as to receive a batch of goods, and is then raised to an intermediate position in which the upper end of the raised basket is engaged with the periphery of the diaphragm. As the press plate is then moved upwardly to its upper position adjacent the lower side of the dome, the basket is moved downwardly to its lower position in the sump so that the goods in the basket are pushed upwardly against the diaphragm. Following locking of the press plate to the dome, and the application of fluid under pressure to the pressure chamber of the dome so as to inflate the diaphragm, the press plate is unlocked from the dome and then lowered back to its lower position. As the press plate is lowered, the basket is moved downwardly so that, when the press plate reaches its lower position, the upper end of the basket is substantially flush with the top side of the press plate so that the pressed goods may be moved laterally off the press plate. Thus, as compared with prior apparatus of this type, as above described, there is no need, following lowering of the press plate, to shift the basket to an upper position in order to provide a space between its lower end and the press plate through which a pusher may be moved for moving the cake laterally off the press plate.

In the preferred embodiment of the invention, the basket includes spaced inner and outer walls and a closed upper end, and the inner wall of the basket is perforated to permit liquid to drain laterally into and through the basket into the sump as it is pressed from the goods. More particularly, the means for raising and lowering the press plate comprises an extendible and retractible actuator beneath the press plate, and the top side of the press plate is imperforate but slotted in a lateral direction to also facilitate drainage of liquid downwardly through the goods. Also, the slots in the top side of the press plate extend in the same direction as the pusher is reciprocated, in order to move the pressed goods laterally off the press plate, thereby providing channels through which parts of the goods, which might otherwise be caught in perforations in the press plate, may slide.

In the drawings, wherein like reference characters are used throughout to designate like parts:

Figure 2:
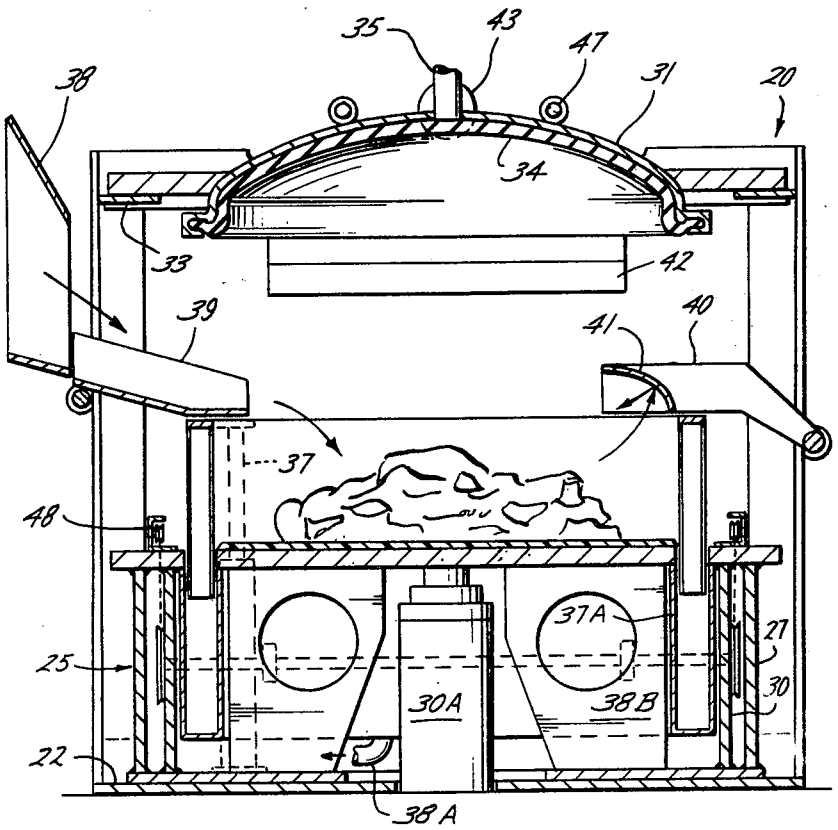
FIG. 2 is a view similar to FIG. 1, but in which the basket has been raised with respect to the press plate to form with the top side of the press plate a container for receiving a batch of goods from an exit chute of a washing machine on the left-hand side of the apparatus.
Figure 1:
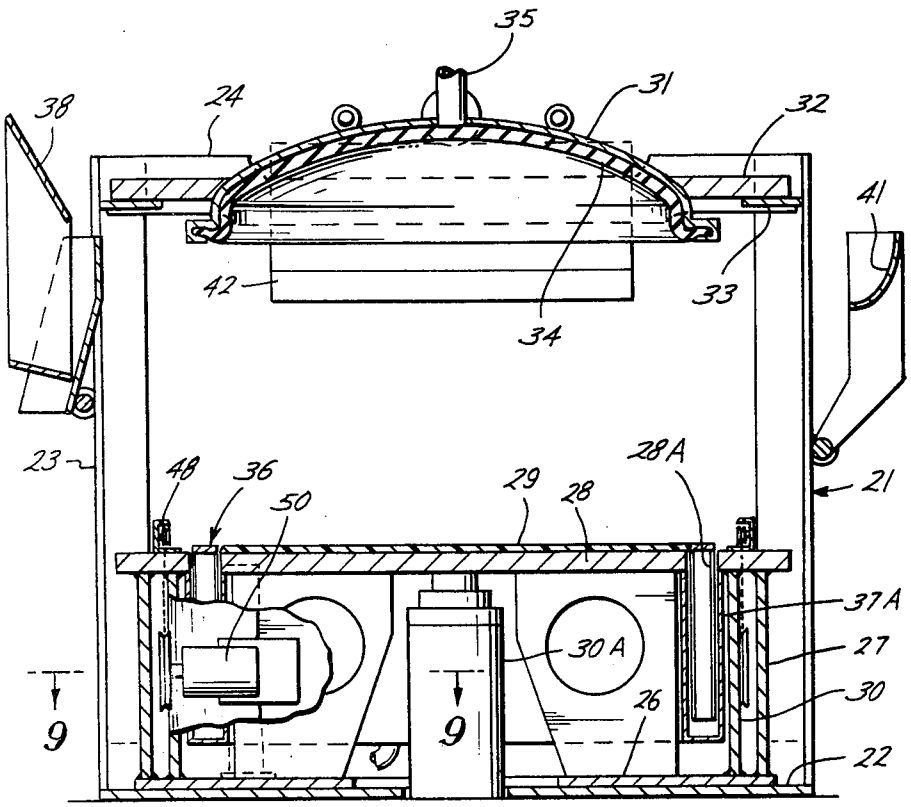
FIG. 1 is a vertical sectional view of an illustrative embodiment of the above-described apparatus, as seen along broken lines 1,2—1,2 of FIG. 8, with the press frame and the basket in their lower positions at the beginning of a press cycle.
Figure 4:
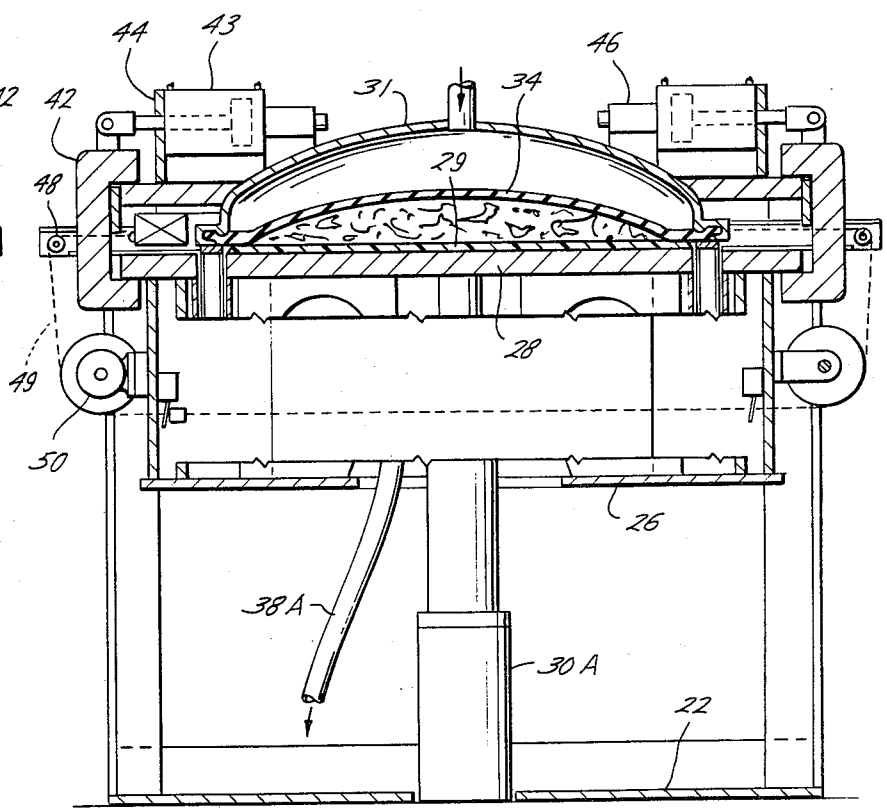
Figure 3:
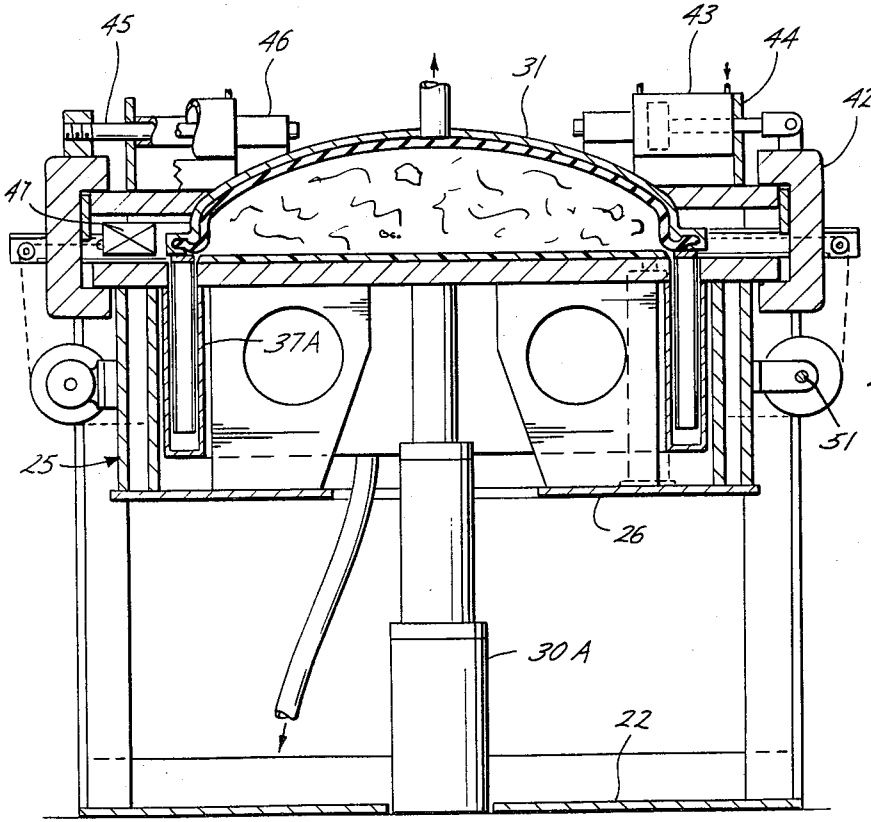
Figure 6:
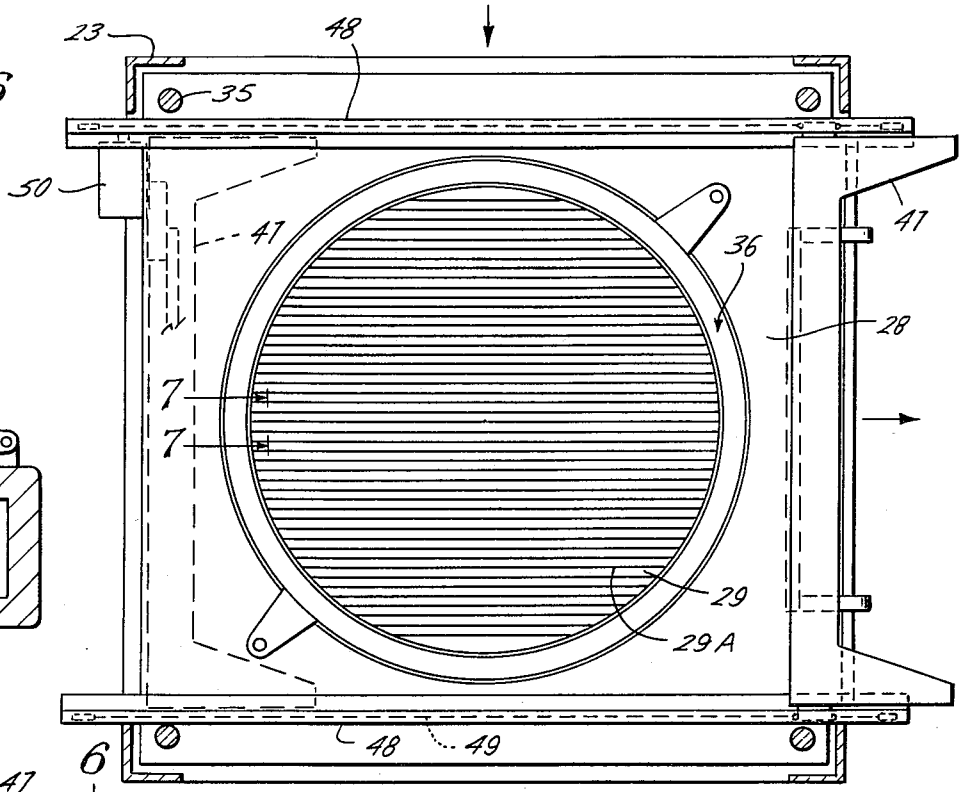
Figure 7:
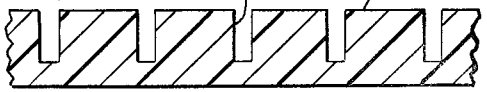
Figure 5:
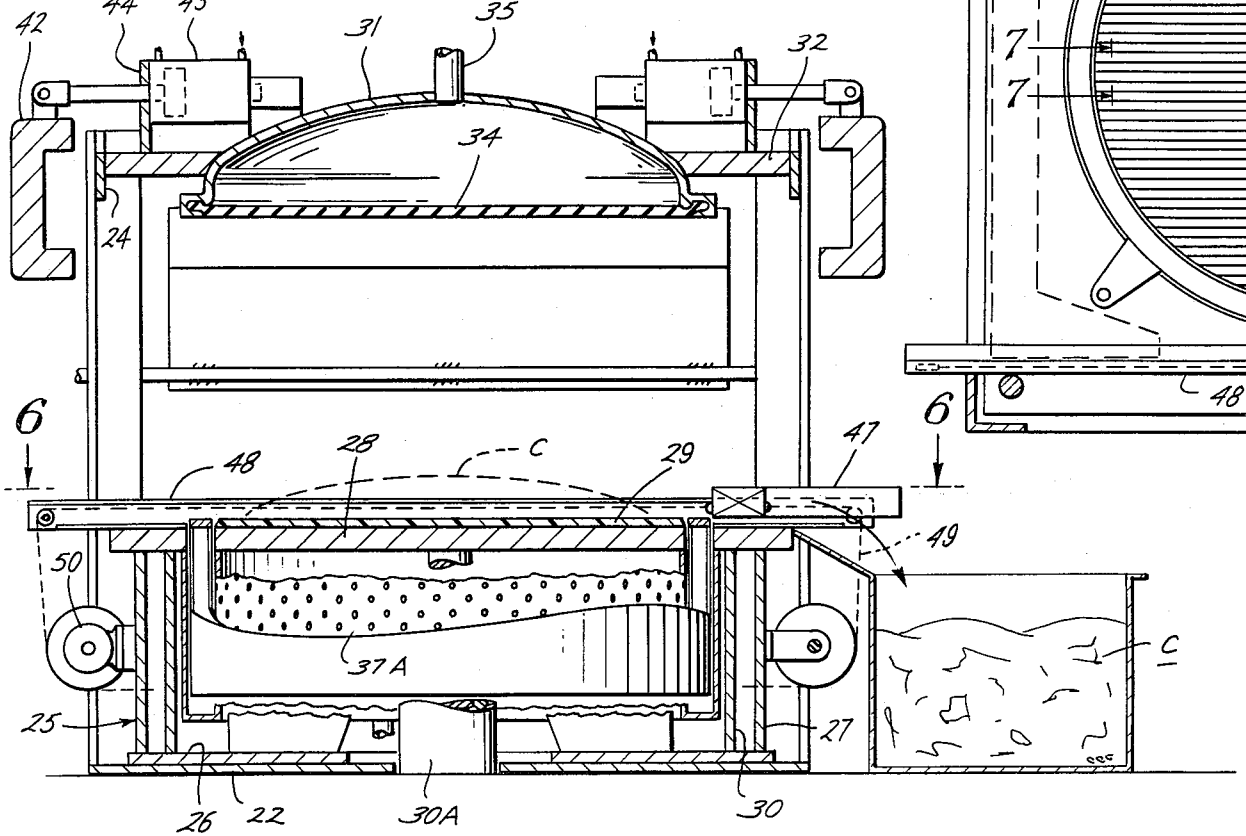
Figures 8, 9, 10:
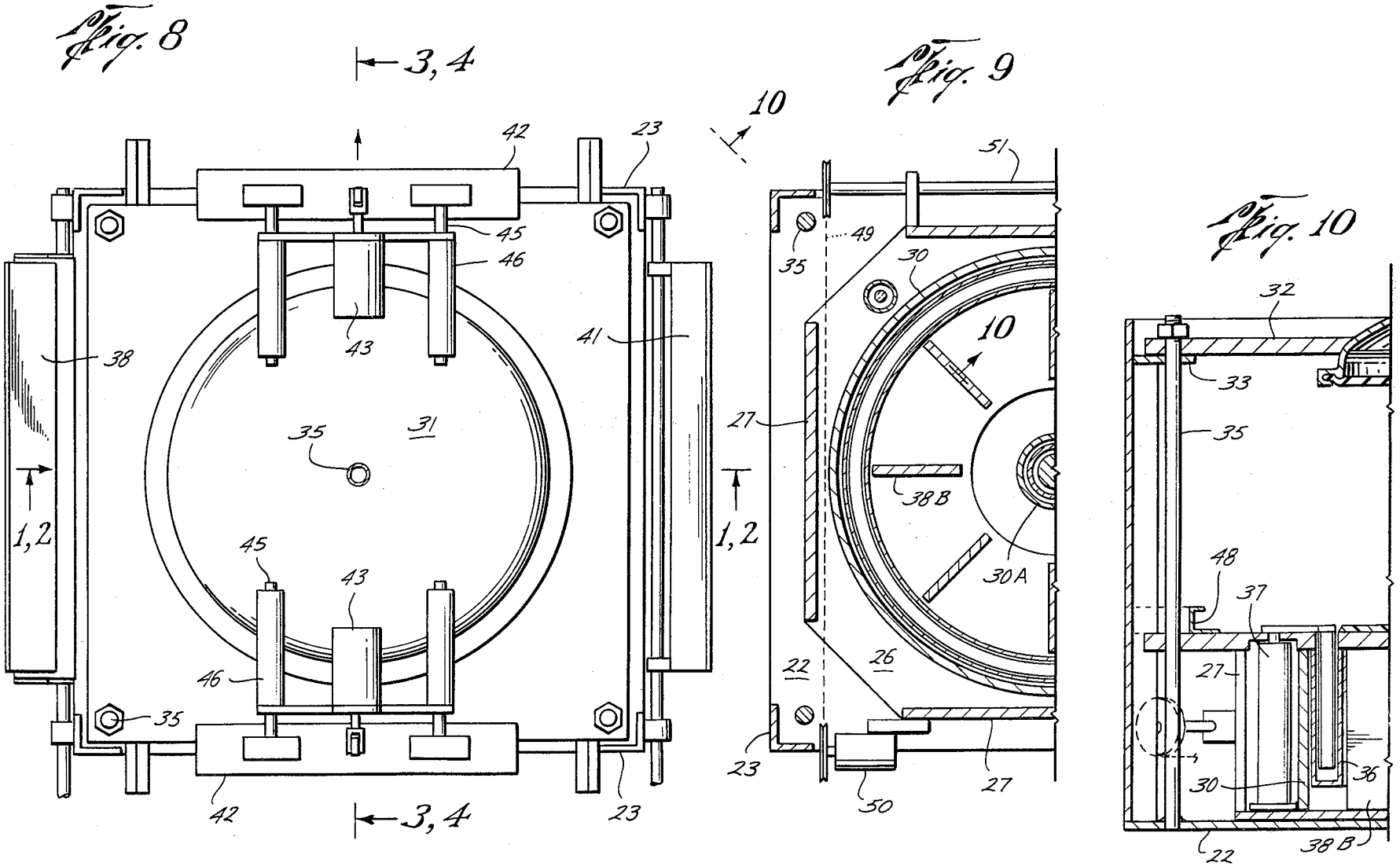

FIG. 3 is a vertical sectional view of the apparatus of FIGS. 1 and 2, as seen along broken lines 3,4—3,4 of FIG. 8, and thus at right angles to FIGS. 1 and 2, and upon upward movement of the press plate to first lift the basket with it into a position in which its upper end is engaged with the periphery of the diaphragm of the dome of the apparatus, and then force the basket into the open upper end of a sump about the press plate as the press plate moves upwardly within the basket to its upper position, the pressure chamber of the dome being evacuated to withdraw the diaphragm into the dome, as the press plate is so raised, in order that goods on its top side and within the basket may be pressed into a space within the dome beneath the diaphragm;

FIG. 4 is a view similar to FIG. 3, but upon the admission of fluid pressure to the pressure chamber above the diaphgram so as to inflate it against the goods on the press plate;

FIG. 5 is a view similar to FIG. 4, but upon lowering of the press plate and thus the basket with the press plate to their lower positions, and movement of a pusher laterally across the top side of the press plate so as to remove the pressed goods or cake (shown in broken lines) from the press plate;

FIG. 6 is a horizontal sectional view of the apparatus, as seen along brokens line 6—6 of FIG. 5, showing the pusher in broken lines in the position it occupies prior to movement in the right-hand direction to the solid line position for removing the cake;

FIG. 7 is an enlarged cross-sectional view of the top side of the press plate;

FIG. 8 is a top plan view of the apparatus, showing the clamps by which the press plate may be locked to the dome in their retracted positions;

FIG. 9 is a horizontal cross-sectional view of one-half of the apparatus, as seen along broken lines 9—9 of FIG. 1; and FIG. 10 is a vertical sectional view of one-half of the apparatus, as seen along broken lines 10—10, and with the press plate and basket in their lower positions, as shown in FIGS. 1 and 5.

With reference now to the details of the above-described drawings, the apparatus, which is indicated in its entirety by reference character 20, includes a frame 21 having a base 22 adapted to be mounted on a horizontal support surface, uprights 23 at the four corners of the base plate, and cross members 24 extending between the upper ends of the uprights 23. Thus, as shown, the frame is essentially open on all four sides for easy access to the dome and press plate.

A press assembly 25 mounted within the frame includes a bottom wall 26 supported on the base 22 of the frame, side walls 27 upstanding from the bottom wall, and a floor 28 supported by the side walls above the bottom wall. The floor has a circular opening 28A to receive a press plate 29 supported on substantially the same horizontal level as the floor by means of bracing walls 38B extending vertically between the bottom wall and press plate. An inner circular wall 30 extends between the floor and bottom wall to provide further support for the floor and form a cylindrical cellar surrounding the opening 28A in the floor.

The press assembly is adapted to be raised and lowered by means of a vertically reciprocable actuator 30A in the form of a telescoping piston and cylinder extending between the bottom of the press plate and the horizontal support surface beneath the frame. During vertical reciprocation, the press assembly is guided at four corners of the floor by means of vertical rods 35 extending between the base 22 of the frame and a horizontally disposed upper supported plate 32 at the upper end of the frame by flanges 33 extending inwardly from the frame uprights 23.

A dome 31 mounted on the plate 32 has a diaphragm 34 of rubber or other inflatable material disposed across its lower open end. When unstressed, the diaphragm assumes the generally horizontal position shown in FIG. 5. A pipe 35 connects with the upper end of the dome so as to permit pressure fluid to be supplied to or exhausted from the pressure chamber formed between the diaphragm and the dome. As indicated in FIGS. 1, 2 and 3, a vacuum may be applied to the line in order to cause the diaphragm to conform with the inner surface of the dome, or, alternatively, pressure fluid may be supplied through the line to force the diaphragm downwardly against the goods received on the press plate, as shown in FIG. 4.

As also previously described, and as shown in the drawings, a basket 36 is mounted for vertical reciprocation within an annular slot between opening 28A in the press floor and the outer periphery of the press plate. The basket is adapted to be reciprocated by means of vertically extending hydraulic actuators 37 between a lower position, as shown in each of FIGS. 1, 3, 4, 5 and 10, wherein the upper end of the basket is essentially flush with the top surface of the press plate, and an upper position, as shown in FIG. 2, in which its upper end is above the press plate. With the press assembly in its lower position, and the basket in its raised position, as shown in FIG. 2, the basket forms with the press plate a container to receive a batch of goods which are emptied from a chute 38 at the exit end of the washing machine. In the lower position of the basket, pressed goods in the form of a cake on the top surface of the plate may be pushed laterally off the press plate, as best illustrated in FIG. 5 without risk of hanging up in the open upper end of the slot.

The basket is vertically reciprocable within a sump 37A which depends from the floor and press plate beneath the slot and into the cellar of the press assembly. As shown, the sump is annular in construction having an inner wall depending from the lower periphery of the press plate, an outer wall depending from the inner periphery of the floor opening 28A, and a closed lower end opposite its open upper end. A hose 38A is connected to the lower end of the sump to permit liquid to drain therefrom.

As shown in FIGS. 1 and 2, at the beginning of a press cycle, the press assembly is in its lower position resting on the base 22 of the frame 21, and the basket 36 is likewise in its lower position in which its upper end is essentially flush with the top side of the press plate and floor surrounding the press plate. As previously described, in addition to essentially closing the upper end of the sump, the upper end of the lowered basket thereby provides a substantially smooth continuation of the top side of the press assembly, so that the pressed goods or cake may be pushed laterally off of the press plate and floor and into the container shown in FIG. 5 without damage thereto.

Immediately following removal of the cake, the pusher of course is returned to its original position, as shown in broken lines in FIG. 6, prior to the beginning of the next cycle, at which time the actuators 37 are extended to lift the press plate to the raised position shown in FIG. 2. At this time, a trough 39 mounted on the side of the frame may be swung downwardly from the position of FIG. 1 to the position of FIG. 2 to guide the wet goods from the chute 38 into the raised basket. At the same time, an arm 40 mounted on the opposite side of the frame may be swung downwardly to dispose a deflector plate 41 on its inner end adjacent the top side of the basket opposite the trough 39. As indicated by the arrows in FIG. 2, plate 41 is useful in preventing goods from being bounced out of the basket as they are emptied into it from the trough 39.

Upon emptying a batch of goods into the raised basket, trough 39 and arm 40 may be raised back to the position shown in FIG. 1, so that the actuator 30A extended so as to move the press assembly, and thus the basket 36, upwardly until the upper end of the basket engages the periphery of the diaphragm 34. During this stage of operation of the apparatus, the basket is held in its upper position by retention of the pressure fluid on the lower side of the piston of the actuator 37.

Upon continued extension of the actuator 30A, the press plate is caused to move further upwardly with the press assembly and thus to move upwardly within the basket so as to press the goods therein against the space within the dome beneath the diaphragm. Thus, as shown in FIG. 2, a vacuum has been pulled on the pressure chamber above the diaphragm to cause the diaphragm to conform to the dome. This relative upward movement of the press plate with respect to the basket, and thus lowering of the basket into the sump, as shown in FIG. 3, is made possible by means of a pressure relief valve (not shown) in the inlet line of the piston end of actuator 37. Thus, the upper end of the basket is maintained engaged with the diaphragm while permitting pressure fluid to be bled from the pressure sides of the actuators.

With the press plate in its upper position essentially flush with the upper end of the basket, clamps 42 on opposite sides of the apparatus may be moved laterally from the outer unlocking positions shown in FIG. 5 to the inner locking positions shown in FIGS. 3 and 4 in which flanges on their upper and lower ends fit over the support plate 32 for the dome as well as the lower side of the floor of the press assembly. At this time, fluid under high pressure may be supplied to the pressure chamber of the dome so as to press the diaphragm downwardly against the goods, as shown in FIG. 4, the clamps preventing this high force from forcing the press assembly downwardly from its upper position.

Liquid which is pressed from the goods, as well as during inflation of the diaphragm (FIG. 4), will drain laterally into the sump and thus through the hose 38. In its preferred form, the basket includes spaced inner and outer walls depending from a closed upper end, with the lower end being open and the inner wall being perforated so as to permit liquid to drain into the sump at all stages of the pressing operation. Although the press plate is imperforate, its top side preferably comprises a cover of plastic or other suitable material provided with slots 29A extending laterally across the press plate to facilitate drainage of liquid downwardly as well as laterally through the goods and into the sump.

The clamps 42 are mounted for horizontal reciprocation between their unlocking and locking positions by means of fluid actuators 43 mounted on upright supporting walls 44 on the support plate for the dome. The clamps are supported and guided during reciprocation by means of rods 45 extending inwardly from their upper ends and received within guide cylinders 46 also mounted on the support wall 44.

Upon completion of the pressing operation best illustrated in FIG. 4, the clamps 42 may be retracted and the actuator 30A caused to contract in order to lower the press assembly to its FIG. 5 position. As the press assembly lowers, the basket will lower with it so that, when the press plate arrives at its lower position, the upper end of the basket is essentially flush with the top side of the press plate and floor. Thus, no additional shifting of the basket is required prior to removal of the pressed goods or cake C, shown in broken lines in FIG. 5, from the top side of the press plate and floor into the container C to one side of the apparatus.

For this latter purpose, a laterally extending pusher 47 is mounted at its ends on tracks 48 extending along opposite sides of the frame for shifting over the top side of the press plate and floor between a position to the left side of the frame, as shown in FIGS. 5 and 6, and a position to the right side thereof, as shown in solid lines in FIGS. 5 and 6. Thus, the pusher is moved from left to right to remove the cake, and from right to left to return to a position for removing a subsequent cake. The pusher is so shifted by means of chains 49 connected at their free ends to parts on the ends of the pusher which slide within the tracks, and wound about sprockets at the ends of the tracks as well as beneath each end of the track. One of the lower sprockets is driven by means of a motor 50 carried by the press assembly, and, as shown in FIG. 9, a rod 51 extends between the other lower sprockets so that both chains may be driven by the same motor.

As shown, the pusher has arms at each end so as to confine the cake somewhat as it is moved laterally off the press plate. Still further, and as shown in FIG. 4, limit switches are mounted on the press assembly at each side thereof so as to be engaged by a part on one chain in the alternate positions of the pusher, thereby automatically stopping its movement in each such position.

As will also be noted from FIG. 6, slots 29A formed in the top side of the press plate extend in the same direction that the pusher is reciprocated, thereby minimizing damage to the goods of the cake, as the pusher is moved laterally across the press plate, as might occur in the case of a perforated press plate.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. Apparatus for use in pressing liquid from cloth goods, comprising a frame, a dome supported by the frame and having a diaphragm across its lower end to form a pressure chamber thereabove, a press plate mounted beneath the dome for vertical reciprocation toward and away from the dome, a sump depending from the press plate for reciprocation therewith and having an open upper end about the periphery of the press plate, a basket mounted for vertical reciprocation within the open upper end of the sump, means for reciprocating the basket between an upper position in which its upper end is above the top side of the press plate, and a lower position in which its upper end is substantially flush with the top side of the press plate, means for raising the press plate from a lower position in which the upper end of the basket, when raised to its upper position, is spaced beneath the dome to form a container into which a batch of goods may be emptied, to an intermediate position in which the upper end of the raised basket is engaged with the periphery of the diaphragm, and then to an upper position in which the basket is moved downwardly to its lower position in the sump, and the press plate is moved upwardly within the basket to press the goods against the diaphragm, means for releasably locking the press plate to the dome in the upper position of the press plate, means for applying fluid under pressure to the pressure chamber of the dome, when the press plate is so locked, in order to inflate the diaphragm and further press the goods against the press plate, and means for lowering the press plate, when unlocked from the dome, back to its lower position, and thus lowering the basket with it in order to permit the pressed goods to be moved laterally off the press plate and upper end of the basket.

2. Apparatus of the character defined in claim 1, wherein the basket includes spaced inner and outer walls and a closed upper end, and the inner wall of the basket is perforated to permit liquid to flow through the basket and into the sump as it is pressed from the goods.

3. Apparatus of the character defined in claim 1, wherein the means for raising and lowering the press plate comprises an extendible and retractible actuator beneath the press plate, and the top side of the press plate is imperforate but has slots extending laterally thereacross to permit liquid to drain therefrom.

4. Apparatus of the character defined in claim 3, wherein the basket includes spaced inner and outer walls and a closed upper end, and the inner wall of the basket is perforated to permit liquid to flow through the basket and into the sump as it is pressed from the goods.

5. Apparatus of the character defined in claim 3, including a pusher which is horizontally reciprocable across the top side of the press plate, when the press plate and basket are lowered, in order to move the pressed goods laterally off the press plate, the slots in the top side of the plate extending in the same direction in which the pusher is reciprocated.

* * * * *